US006693246B1

(12) United States Patent
Rudolph et al.

(10) Patent No.: US 6,693,246 B1
(45) Date of Patent: Feb. 17, 2004

(54) ROCKER SWITCH FOR ONE TWO-STAGE ACTUATING STROKE

(75) Inventors: Gerd Rudolph, Aspisheim (DE); Holger Besier, Oestrich-Winkel (DE)

(73) Assignee: Delphi Technologies, Inc., Troy, MI (US)

( * ) Notice: Subject to any disclaimer, the term of this patent is extended or adjusted under 35 U.S.C. 154(b) by 13 days.

(21) Appl. No.: 10/088,956

(22) PCT Filed: Sep. 13, 2000

(86) PCT No.: PCT/DE00/03211

§ 371 (c)(1),
(2), (4) Date: Mar. 22, 2002

(87) PCT Pub. No.: WO01/24209

PCT Pub. Date: Apr. 5, 2001

(30) Foreign Application Priority Data

Sep. 25, 1999 (DE) ..... 199 46 020

(51) Int. Cl.[7] ..... H01K 9/00
(52) U.S. Cl. ..... 200/1 B; 200/5 R; 200/339
(58) Field of Search ..... 200/1 B, 4, 5 R, 200/6 R, 17 R, 18, 339, 553

(56) References Cited

U.S. PATENT DOCUMENTS 5,412,164 A * 5/1995 Conway et al. ..... 200/1 B
5,693,920 A * 12/1997 Maeda ..... 200/1 B
5,753,874 A * 5/1998 Kossakowski ..... 200/1 B
5,834,716 A * 11/1998 Lee ..... 200/5 R
6,274,826 B1 * 8/2001 Serizawa et al. ..... 200/5 R
6,437,259 B1 * 8/2002 Geppert et al. ..... 200/5 R

FOREIGN PATENT DOCUMENTS

| | | | |
|---|---|---|---|
| DE | 4326226 | 2/1994 | ..... H01H/23/24 |
| DE | 19600657 | 1/1996 | ..... H01H/23/24 |
| DE | 19537296 | 4/1996 | ..... H01H/23/28 |
| EP | 604837 | 7/1994 | ..... H01H/23/16 |

* cited by examiner

*Primary Examiner*—Michael Friedhofer
(74) *Attorney, Agent, or Firm*—David P. Wood

(57) ABSTRACT

A rocker switch for one two-stage actuating stroke, especially in the form of a window control switch for a motor vehicle. The rocker switch includes a rocker button which is mounted in a housing. An actuating plate for acting on switching contacts that are connected to terminal contacts is associated with said rocker button. A switching contact is allocated to the actuating stroke of the first stage in each direction, respectively and a common switching contact is allocated to the actuating stroke of the second stage in each direction, respectively.

12 Claims, 3 Drawing Sheets

ROCKER SWITCH FOR ONE TWO-STAGE ACTUATING STROKE

TECHNICAL FIELD

The invention generally relates to electrical switches, and more particularly relates to rocker switches having a two-stage actuating stroke.

BACKGROUND OF THE INVENTION

DE 195 37 296 A1 details a rocker switch device for a two-stage actuating stroke that is part of an actuating unit for electric window openers of a motor vehicle and comprises a pair of actuating plates underneath a longitudinal middle line of a rocker button. The actuating plates are coupled by elastic connecting arms and form an actuating member in this manner. Each actuating plate loads two pressure switches formed by a switching mat with hollow projections and with contact pieces arranged therein and by a base plate with fixed contact pieces associated with the moveable contact pieces. When the rocker button is actuated it pivots about carrier axle ends of a housing so that the actuated side of the rocker button moves down. This downwardly directed movement is transmitted via the associated actuating plate to the left and right projections, arranged underneath this plate, of the switching mat. The projections are arranged in such a manner that as a result of the differently acting torques at first the left projection is deformed and a circuit is closed by the contact of the contact pieces arranged here and after a further downward movement of the rocker button the right projection is also pressed downward by the actuating plate and another circuit is closed. After the rocker button is released it is automatically returned, which interrupts the closed circuit. The rocker switch device accordingly comprises a plurality of contact pieces and actuating plates that bring about the appropriate switching functions for controlling the electric window opener, which necessitates an extremely complex design of the rocker switch device.

Furthermore, a multi-stage rocker switch is known from DE 196 00 657 C1 that consists substantially of a rocker button pivotably supported on the housing and of four push rods received by a conductor plate, which rods are arranged beneath the rocker button. The conductor plate is arranged inside the housing parallel to a conductor plate. Each push rod acts with a dome of a switch mat that receives a contact piece that makes contact with a fixed contact piece upon a loading of the dome by the associated push rod after the dome is bent in and closes a current path. Each two adjacent domes have a different stability, which has, as a consequence, a bending in upon a different action of force. The two push rods arranged in the area of each front side of the rocker button and loading the corresponding, adjacent domes are actuated by an associated appendage of the rocker button which appendage acts on an intermediate element supported in the conductor plate in such a manner that this element can pivot and also shift vertically. To this end the intermediate element comprises horizontal guide pins resting in corresponding grooves of the conductor plate. The intermediate element is designed as a two-arm lever and a push rod is associated with each lever arm. When the rocker button is actuated, the associated intermediate element is loaded via the appendage of the rocker button with a pressure force opposed by the different pressure forces of the domes. The dome associated with an actuating stroke of a first state bends in, while the intermediate element is shifted vertically as well as pivoted, since the associated lever arm constantly rests on the corresponding push rod on account of the acting forces. Upon an actuating stroke of a second stage the dome adjacent to the first dome also bends in, while the two lever arms are located in a horizontal position and the intermediate element is shifted vertically in the direction of the domes by a further path stretch. The rocker switch is disadvantageous in as far as a very complex switching mechanism is provided for realizing a two-stage actuating stroke.

In addition, EP 0 604 837 A1 teaches a hand-actuated control switch for a raising device with a rocker switch for a two-stage actuating stroke in which a rocker button is pivotably supported in a front plate of a housing. The rocker button is associated with an actuating device comprising two levers for loading switching contacts. The switching contacts are arranged in a series on a conductor plate. The actuating stroke of the first stage is associated in each direction with the particular outer switching contact and the actuating stroke of the second stage is associated in each direction with the central switching contact. Each lever of the actuating device loads one of the outer switching contacts and both levers actuate the central switching contact.

The invention has the problem of creating a rocker switch of the initially cited type that is distinguished by a compact design with the lowest possible number of structural components and with a reliable operation.

The invention solves this problem in that the operating stroke of the first stage is associated in each direction with a switching contact and the actuating stroke of the second stage is associated in each direction with a joint switching contact.

Based on these measures, the rocker switch comprises only three switching contacts for one two-stage actuating stroke, which results in a compact design and a relatively low number of structural components. The particular switching contact of the actuating stroke of the first stage furnishes a signal about the direction in which the rocker button was loaded and initiates a first switch operation. The actuation of the switching contact associated with the actuating stroke of the second stage brings about another signaling that initiates a second switch operation associated with the first switch operation. For example, the particular switching contact associated with the actuating stroke of the first stage initiates an up or down movement of an associated motor vehicle window that is ended after the rocker button has been released. The joint switching contact for the actuating stroke of the second stage controls a movement of the corresponding motor vehicle window up to its end position, the direction of which is given by the particular first-actuated switching contact. A reliable operation of the rocker switch is assured on account of connection of the second switch operation to the first switch operation. The coupling of the operation of the particular first-loaded switching contact to the operation of the joint switching contact can be realized electrically or via an appropriate control of on-board electronic components.

According to an advantageous embodiment of the invention the three switching contacts are arranged in the form of an equilateral triangle. The switching contacts of the actuating stroke of the first stage are each arranged at a corner point of the base and the switching contact of the actuating stroke of the second stage is arranged at the apex of the triangle. It is advantageous if the base of the equilateral triangle runs parallel to a side wall of the housing and its apex is located under a shaft of the rocker button of the opposite side wall. This arrangement of the switching contacts results in a compact design of the rocker switch and a tactile determination of the first and second stages of the actuating stroke. The switching contacts associated with the first stage of the actuating stroke are arranged at a relatively large spacing from the shaft of the rocker button, so that an appropriate lever arm is available to load them, for which reason the actuation of these switching contacts requires a lesser force in comparison to the actuation of the switching contact arranged on the apex, for which no lever arm is available to load it.

The actuating plate is advantageously supported by way of associated studs on the switching contacts under lateral play relative to the housing. The actuating plate and the studs form a unit in order to transfer the motion of the rocker button on the appropriate switching contact or contacts. Furthermore, no support for the freely movable actuating plate is provided.

In order to impart an appropriate stability to the actuating plate and assure a pivoting motion of the actuating plate as a function of the actuating direction of the rocker button, the actuating plate is provided in a purposeful manner with a crosspiece offset off-center to the longitudinal axis of the switch in the direction of the switching contact located at the triangle apex. An appendage of the rocker button rests on this crosspiece on each of the two sides of the rocker button shaft. As a result of the off-center arrangement of the crosspiece the actuating plate pivots upon an introduction of force on one side via the associated appendage about the corresponding side of the triangle in which side the switching contacts are arranged. Furthermore, the actuating plate is held between the switching contacts and the appendages of the rocker button so that no shifting of the actuating plate due to vibration occurs.

The crosspiece of the actuating plate preferably displays a semicircular clear space for the shaft of the rocker button. The clear space makes possible the pivoting movement of the actuating plate, that does not take place perpendicularly to the shaft but rather about the corresponding side of the triangle, for which reason the actuating plate readily rotates in this instance.

The rocker button advantageously comprises two opposing support lugs for receiving the shaft. Furthermore, the shaft advantageously engages in support bores in the side walls of the housing, with a disk arranged between the side wall and the support lug of the rocker button in each instance, which assures a reliable support of the rocker button. The disk arranged between the particular side wall of the housing and the corresponding support lug of the rocker button reduces the friction between these components when the rocker button is pivoted.

In an alternative embodiment of the invention the shaft is designed as axle ends formed on the opposite support lugs of the rocker button which axle ends engage in corresponding support bores in the side walls of the housing. This embodiment creates a reliable support of the rocker button in the housing with a relatively low number of individual parts to be mounted.

According to an advantageous further development of the concept of the invention the switching contacts are designed as snap disks that cooperate with contact paths of a punched grid set in the housing bottom. In an alternative embodiment the switch contacts are designed as snap disks that cooperate with contact paths of a conductor plate lying on the bottom of the housing. The snap disks have a pre-tension that assures the return movement of the rocker button. The punched grid is injected during the injection-molding process for manufacturing the housing into its bottom.

Each snap disk is preferably held via two lock bolts on the sides of the housing. The mounting of the snap disks takes place without great expenditure by simply inserting the snap disks between the lock bolts, which assure a sufficient fixing.

DETAILED DESCRIPTION OF THE PREFERRED EMBODIMENTS

Figure 1:
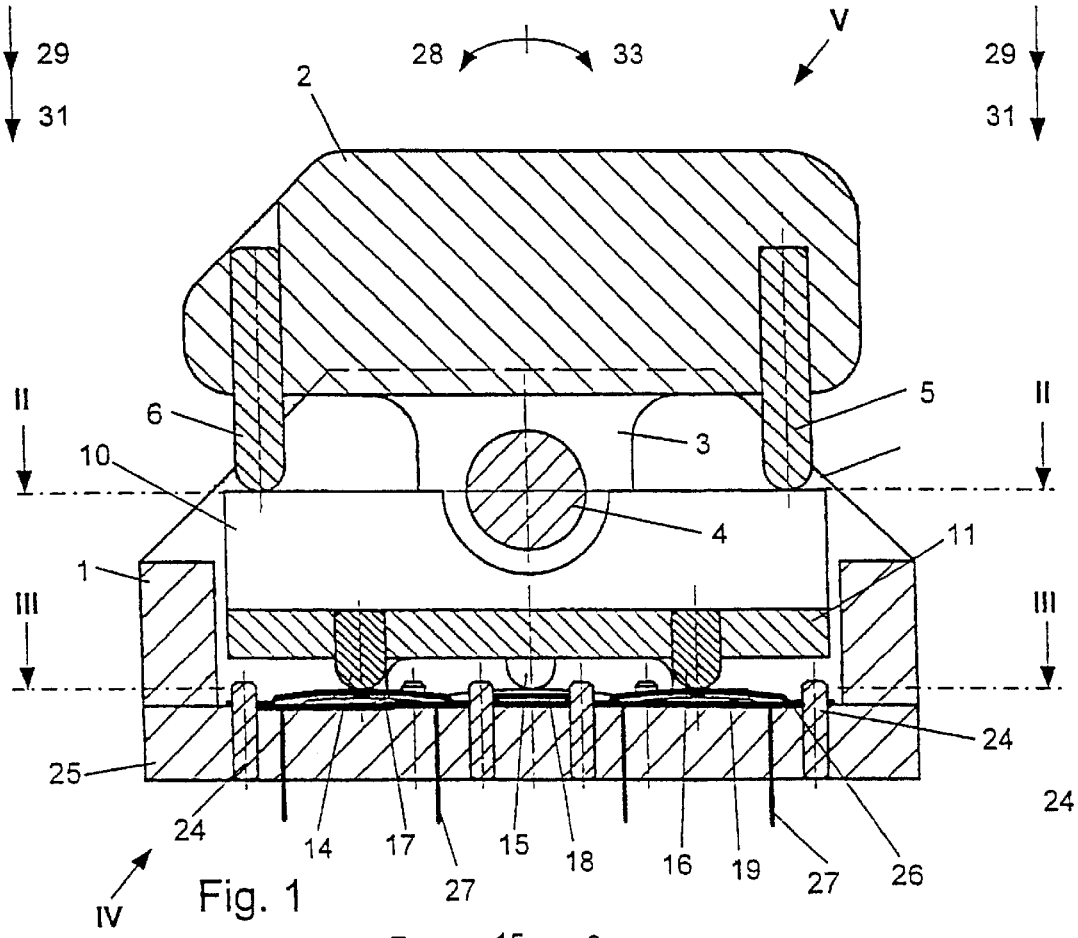
FIG. 1 shows a longitudinal section through a rocker switch in accordance with the invention.
Figure 2:
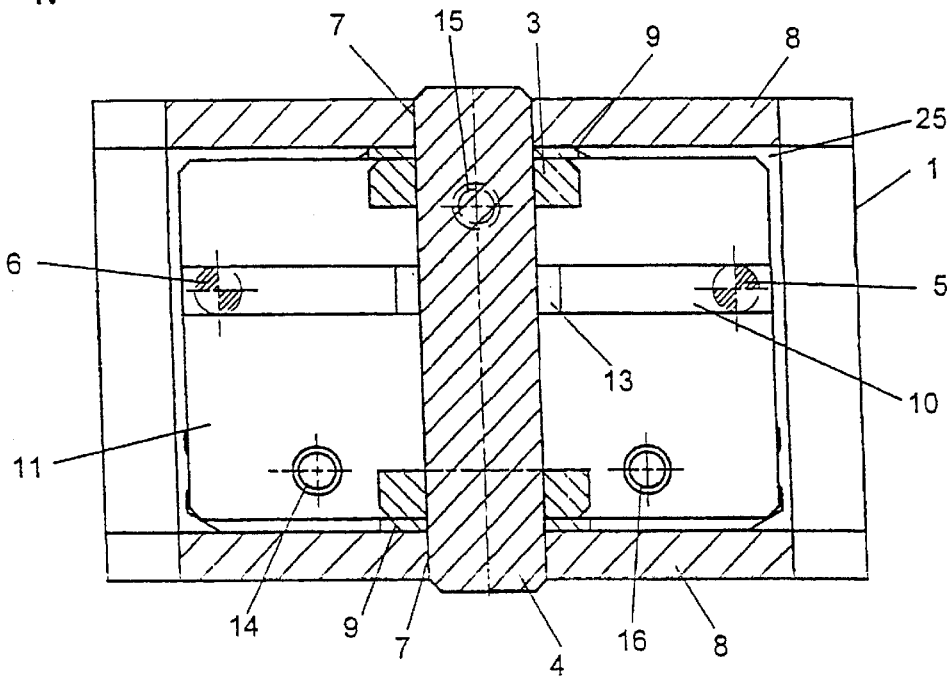
FIG. 2 shows a section through the view of FIG. 1 along line II—II.
Figure 3:
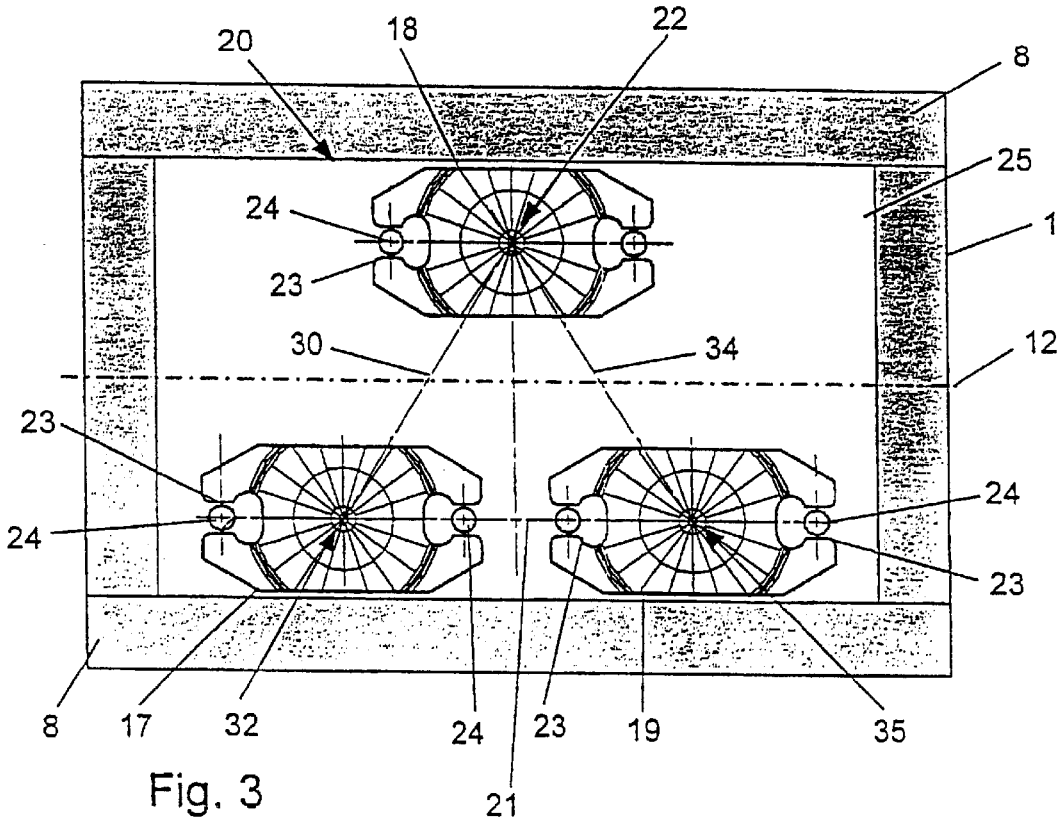
FIG. 3 shows a section through the view of FIG. 1 along line III—III.
Figure 4:
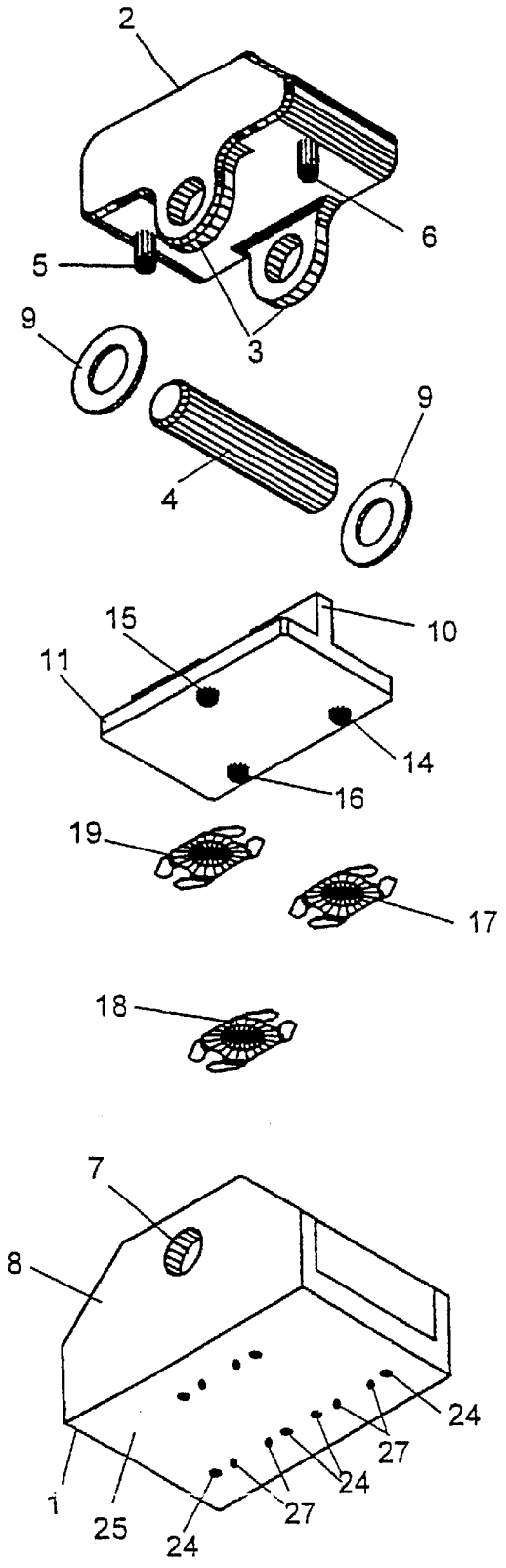
FIG. 4 shows an exploded view of the rocker switch of FIG. 1 in the direction of arrow IV.
Figure 5:
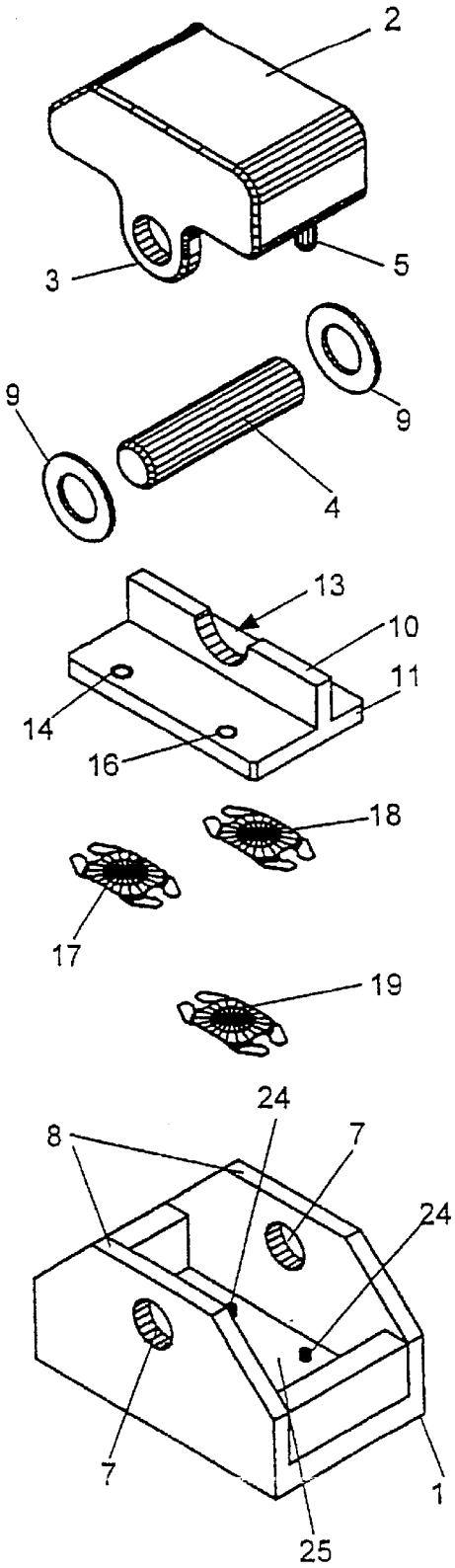
FIG. 5 shows an exploded view of the rocker switch of FIG. 1 in the direction of arrow V.

The rocker switch comprises rocker button 2 supported in housing 1 and with support lugs 3 formed on opposing longitudinal sides for receiving shaft 4. In addition, rocker button 2 comprises appendages 5,6 arranged on both sides of shaft 4. Shaft 4 is inserted in corresponding support bores 7 in side walls 8 of housing 1. Disk 9 is provided between support lugs 3 of rocker button 2 and the associated side wall 8 to reduce the friction. Appendages 5,6 of rocker button 2 rest on crosspiece 10 of actuating plate 11. This crosspiece 10 is offset off-center to longitudinal switch axis 12 (see FIG. 2) and comprises semicircular clear space 13 for shaft 4 of rocker button 2. Actuating plate 11 is inserted with lateral play into housing 1 and is supported via associated studs 14, 15, 16 on switching contacts 17, 18, 19 that are designed as snap disks and arranged in the form of equilateral triangle 20. Base 21 of the equilateral triangle with the particular switching contacts 17, 19 on the end side runs parallel to the corresponding side wall 8 of housing 1. Switching contact 18 on apex 22 of triangle 20 is associated under shaft 4 of rocker button 2 with the opposite side wall 8 (see FIG. 3).

Each switching contact 17, 18, 19 is held by opposing recesses 23 that receive corresponding lock bolts 24, wherein the lock bolts 24 are arranged in bottom 25 of housing 1. Conductor plate 26 is located on bottom 25 and comprises contact paths associated with switching contacts 17, 18, 19, the connection contacts 27 of which paths extend to the outside through bottom 25 of housing 1.

When rocker button 2 is pivoted in the direction of arrow 28 by one actuating stroke of first stage 29, appendage 6 of rocker button 2 acts on crosspiece 10 of actuating plate 11. Since this crosspiece is arranged offset to longitudinal switch axis 12 in the direction of apex 22 of triangle 20 and studs 14, 15, and 16 of actuating plate 11 rest on associated switching contacts 17, 18, 19, actuating plate 11 pivots about leg 30 of triangle 20. As a result of the acting lever conditions, stud 14 associated with switching contact 17 presses the latter down so that a corresponding, first electric circuit of conductor plate 26 is closed. The first circuit, closed by switching contact 17, brings about the controlling of a window opener motor that opens an associated motor vehicle window. After rocker button 2 is released, this circuit is opened and the motor vehicle window remains in the position reached. Rocker button 2 is returned into its initial position by the return movement of switching contact 17.

The pivoting of rocker button 2 in the direction of arrow 28 by an actuating stroke of second stage 31 brings about the previously explained pivot movement of actuating plate 11 about leg 30 of triangle 20 and the pressing down of switching contact 17 on corner point 32 of base 21 of triangle 20 as well as the closing of the first circuit, with which the opening movement of the motor vehicle window is associated. The actuation of switching contact 18 on apex 22 of triangle 20 subsequently takes place by stud 15 of actuating plate 11. The actuation of switching contact 18 requires an elevated expenditure of force in contrast to the actuation of switching contact 17 on account of the acting lever conditions. The closing of a second circuit by switching contact 18 also brings about a controlling of the window opener motor, which motor moves the motor vehicle window either rapidly and/or into an open end position. After rocker button 2 is released, it returns to its initial position due to the return movements of switching contacts 17, 18 and the motor vehicle window either remains in the position reached or moves into its open end position.

If rocker button 2 is pivoted in the direction of arrow 33 by one actuating stroke of first stage 29, stud 5 loads actuating plate 11, which causes it to pivot about leg 34 of triangle 20. Stud 16 of actuating plate 11 presses associated switching contact 19 onto conductor plate 26, as a result of which a circuit is closed that controls the corresponding window opener motor, that brings about a closing movement of the motor vehicle window. The release of rocker button 2 effects an opening of the circuit and, associated with this, the motor vehicle window remains in the position reached. The return of rocker button 2 takes place by the return movement of switching contact 19, that pivots actuating plate 11 connected to rocker button 2 via appendage 5 into a position parallel to bottom 25 of housing 1.

The pivoting of rocker button 2 in the direction of arrow 33 by one actuating stroke of second stage 31 has as a consequence the previously explained pivoting movement of actuating plate 11 about leg 34 of triangle 20 and the pressing down of switching contact 19 on corner point 35 of base 21 of triangle 20 as well as the associated closing movement of the motor vehicle window. After switching contact 19 has reached its end position on conductor plate 26, switching contact 18 is loaded by corresponding stud 15 of actuating plate 11 and the second circuit on conductor plate 26 is closed. As a result thereof, the controlled window opener motor moves the motor vehicle window either rapidly and/or into a closed end position. The release of rocker button 2 causes the motor vehicle window to either remain in the position reached or to move into its closed end position. Furthermore, rocker button 2 returns to its initial position due to the return movements of switching contacts 18, 19.

The cooperation of switching contacts 17, 19 of the particular first stage 29, arranged in corner points 32, 35 of triangle 20, with switching contact 18 assigned to apex 22 of triangle 20 is realized by an appropriate electric circuit or by the control of on-board electronic circuitry. The on-board electronic circuitry stores directional information in the particular first stage, initiated by switching contact 17 or switching contact 19 for opening or closing the motor vehicle window, and, if necessary, after the particular second stage 31 has been reached, assigns further information effected by switching contact 18 to the directional information. This information of the particular second stage 31 of the actuating stroke causes the motor vehicle window to execute a rapid movement and/or to move into one of the end positions. The movement either opens or closes the motor vehicle window as a function of the previously stored information.

List of Reference Numerals

1 housing
2 rocker button
3 support lug
4 shaft
5 appendage
6 appendage
7 support bore
8 side wall
9 disk
10 crosspiece
11 actuating plate
12 longitudinal switch axis
13 clear space
14 stud
15 stud
16 stud
17 switching contact
18 switching contact
19 switching contact
20 triangle
21 base
22 apex
23 recess
24 lock bolt
25 bottom
26 conductor plate
27 connection contact
28 arrow
29 first stage
30 leg
31 second stage
32 corner point
33 arrow
34 leg
35 corner point

What is claimed is:

1. A rocker switch having a two-stage actuating stroke, comprising:

a rocker assembly, a first, a second, and a third switching contact movable by said rocker assembly, wherein said first, second, and third switching contacts are arranged in a triangular pattern, wherein said rocker assembly is capable of rocking in a first and second forward position and a first and second rearward position, wherein when said rocker assembly is rocked into said first forward position said first switching contact is actuated and when said rocker is rocked into said second forward position, said second switching contact is activated, and when said rocker assembly is rocked into said first rearward position said third switching contact is actuated and when said rocker assembly is rocked into said second rearward position, said second switching contact is activated.

2. The rocker switch of claim 1, wherein said rocker assembly and said switching contacts are contained in a common housing, wherein said rocker assembly includes a rocker button and an actuating plate, wherein the rocker button is pivotally connected to said housing by way of a shaft, wherein said shaft includes a longitudinal axis, and wherein said rocker button is sufficiently spaced about said shaft such that it is capable of pivoting about an axis that is not coincidental with said longitudinal axis of said shaft.

3. The rocker switch of claim 2, wherein a semicircular clear space exists between said actuating plate and said shaft.

4. The rocker switch of claim 2, wherein the shaft engages support bores in a side wall of said common housing and wherein a disk is arranged between the side wall and a support lug of the rocker button.

5. The rocker switch of claim 2, wherein the switching contacts are designed as snap disks that cooperate with contact paths of a punched grid set in a bottom of the housing.

6. The rocker switch of claim 5, wherein said snap disks are held by two respectively associated lock bolts.

7. The rocker switch of claim 2, wherein the switching contacts are designed as snap disks that cooperate with contact paths of a conductor plate residing on a bottom of the housing.

8. The rocker switch of claim 1, wherein said rocker assemble includes a rocker button and an actuating plate, wherein said actuating plate is coupled to said first, second, and third switching contacts.

9. The rocker switch of claim 8, wherein said actuating plate includes first, second and third studs for respectively engaging said first, second and third switching contacts.

10. The rocker switch of claim 8, wherein said actuating plate includes a cross piece, and wherein said rocker button includes a longitudinal axis, and wherein said cross piece is offset from said longitudinal axis of said rocker button.

11. The rocker switch of claim 10, wherein said rocker button includes appendages for engaging the cross piece.

12. The rocker switch of claim 8, wherein said rocker button includes two opposing support lugs.

* * * * *